United States Patent [19]

Coffin

[11] 4,002,901

[45] Jan. 11, 1977

[54] PHOTODETECTOR NON-RESPONSIVE TO CERENKOV RADIATION

[75] Inventor: Jack Caryl Coffin, Lancaster, Pa.

[73] Assignee: RCA Corporation, New York, N.Y.

[22] Filed: Nov. 17, 1975

[21] Appl. No.: 632,813

[52] U.S. Cl. ..... 250/211 R; 250/213 VT; 250/361 R; 315/94

[51] Int. Cl.[2] ..... H01J 39/12; H01J 31/50

[58] Field of Search ..... 250/361–369, 250/213 VT, 211 R; 315/94

[56] References Cited

UNITED STATES PATENTS

| | | | |
|---|---|---|---|
| 3,600,578 | 8/1971 | Porges et al. | 250/379 |
| 3,838,273 | 9/1974 | Lusano | 250/213 VT |
| 3,887,810 | 6/1975 | Skaggs | 250/213 VT |

*Primary Examiner*—Alfred E. Smith
*Assistant Examiner*—David K. Moore
*Attorney, Agent, or Firm*—Glenn H. Bruestle; William H. Murray

[57] ABSTRACT

A photodetector comprises an evacuated envelope with a transparent face plate. The face plate is selected from a material which causes total internal reflection of photons produced by cerenkov radiation. In the evacuated envelope are an anode and a transmissive type photocathode. The photocathode is spaced apart from the face plate.

6 Claims, 2 Drawing Figures

PHOTODETECTOR NON-RESPONSIVE TO CERENKOV RADIATION

BACKGROUND OF THE INVENTION

The present invention relates to transmissive type photodetector tubes and more particularly to transmissive type photodetector tubes designed to be non-responsive to Cerenkov radiation generated in the body of the tube.

A transmissive type photodetector tube is a tube with a photocathode of a material which emits electrons in response to impinging photons with the electrons being emitted from a surface opposite the surface on which photons impinge. Heretofore, some transmissive type photodetector tubes have comprised an evacuated envelope with a transparent face plate. The photocathode is on the face plate within the evacuated envelope. In contrast, a reflective type photodetector tube is a tube with a photocathode of a material which emits electrons in response to impinging photons with the electrons being emitted from the same surface as that on which photons impinge. Some of the reflector type photodetector tubes have comprised an evacuated envelope with a transparent face plate. The photocathode is mounted in the envelope spaced apart from the face plate, since the photoelectrons are emitted substantially in the direction opposite to the direction of the impinging photons, i.e. the photoelectrons are directed toward the source of the photons or toward the face plate. Thus, the gap between the reflective photocathode and the face plate is fairly large, to allow room for electrons emitted from the photocathode. Typically this gap is on the order of an inch or more. However, in certain applications it is desirable to have the photocathode as close as possible to the source of the photons. By having the photocathode close to the source of photons, the photocathode can collect more of them because there is less divergence in the beam of photons. In these uses a transmissive type photodetector is highly desirable because it is able to get closer to the source of photons than a reflective type photodetector.

One such application is in high energy physics, such as experiments involving an accelerator. However, in such application high speed charged particles are often found and Cerenkov radiation results. Cerenkov radiation is the emission of light by a high speed charged particle when the particle passes through a transparent, non-conducting material, such as the face plate of a photodetector tube, at a speed greater than the speed of light in the material. In those applications where there are high speed charged particles sufficient to cause Cerenkov radiation, a transmissive type photodetector tube with the photocathode on the face plate in the tube would detect not only the light that it is suppose to detect, but the photodetector tube would also respond to the light caused by the high speed charged particles passing through the face plate of the photodetector tube. Thus, extraneous light results and the recordation of the extraneous light occurs.

SUMMARY OF THE INVENTION

A photodetector tube comprises an evacuated envelope with a face plate. The face plate is selected from a transparent material which causes internal reflection of photons generated by Cerenkov radiation. Within the evacuated envelope are a transmissive type photocathode spaced apart from the face plate and an anode.

DETAILED DESCRIPTION OF THE DRAWING

Figure 1:
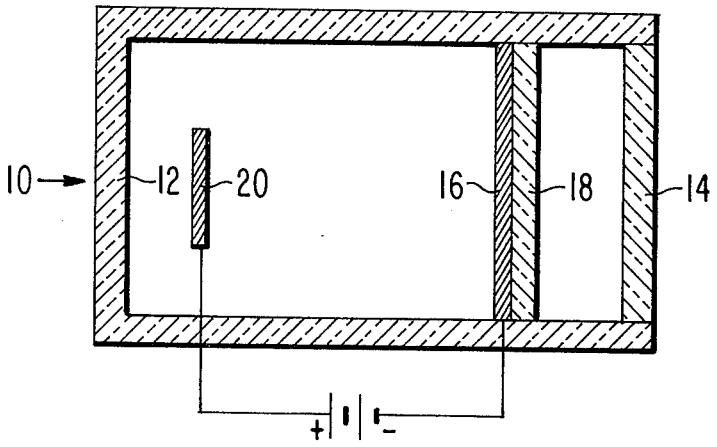
FIG. 1 is a cross-sectional view of a transmissive type photodetector tube of the present invention.

Referring to FIG. 1 there is shown a photodetector tube of the present invention, generally designated as 10. The photodetector tube 10 comprises an evacuated envelope 12, with a face plate 14. Within the evacuated envelope is a transmissive type photocathode 16, which is spaced apart from the face plate 14. For support purpose only the photocathode 16 can be mounted on a support 18. The support 18 is interposed between the photocathode 16 and the face plate 14, and is also spaced apart from the face plate 14. An anode 20 is also within the evacuated envelope 12 in a linear relationship with respect to the photocathode 16 and the face plate 14. The photocathode 16 is between the anode 20 and the face plate 14. As it is obvious to one skilled in the art dynodes, to amplify the photoelectrons, can be placed between the anode 20 and the photocathode 16.

The evacuated envelope 12 can be made from any mechanically strong material, such as glass, quartz, metal or ceramic. The face plate 14 must be made from a transparent material, such as glass, quartz or mica. The support 18 can be made from a translucent material, such as glass, quartz or mica. Since the support 18 need only support the photocathode 16, it can be very thin, such as a 0.0002 inch (0.000508 cm.) thick piece of mica. The photocathode 16 can be made from any material well known to those skilled in the art, such as GaP, GaAs or any of the multialkali materials. The anode 20 can be made from any metal. The photodetector tube 10 can be made by methods well-known to those skilled in the art.

Figure 2:
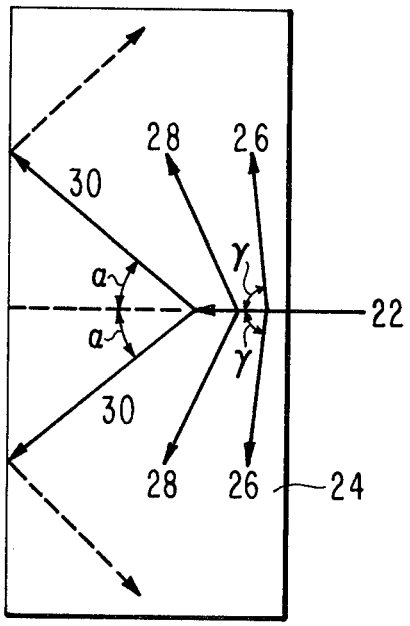
FIG. 2 is a schematic view of the production of Cerenkov radiation by a high speed charged particle.

The theory of operation of the photodetector tube 10 of the present invention can be understood by referring to FIG. 2. In FIG. 2, a high speed charged particle 22 is shown as impinging a transparent material 24. If the speed of the particle 22 is sufficient to produce Cerenkov radiation, i.e. the speed of the particle 22 is greater than the speed of light in the material 24, then photons 26 are initially emitted as the charged particle 22 enters the material 24. The photons 26 are emitted in a conically shaped pattern, with each photon 26 at an angle $\gamma$ from the direction of the charged particle. As the charged particle 22 continues to traverse through the translucent material 24, photons are continuously emitted in a concially shaped pattern — so long as the speed of the particle 22 is greater than the speed of light of the material 24. As the charged particle 22 slows down in the material 24, but still with speed greater than the speed of light of the material 24, the photons that are emitted will take on a conical shape with the angle of the cone smaller than the angle of the cone of the photons previously emitted. Thus, in FIG. 2 as the charged particle 22 slows down, after emitting the photons 26, the angle of the cone of photons 28 emitted will be less than the angle of the cone of the photons 26. As the charged particle 22 slows down even more, the angle of the cone of photons 30 emitted will be less than the angle of the cone of the photons 28. For any given transparent material 24, there is a critical angle at which if light impinges on the material 24 at an angle greater than the critical angle, as measured from a normal to the material 24, then total internal reflection occurs. In FIG. 2, if the angle $\alpha$, which is the angle of the cone of photons 30, is greater than the critical angle of the material 24, then total internal reflection would occur, as shown by the dotted arrows.

Referring to FIG. 1, it is clear that by having the photocathode 16 spaced apart from the face plate 14 and by appropriate selection of the material for the face plate 14, that the Cerenkov radiation produced in the face plate 14 would be totally internally reflected in the face plate 14; the photons produced by the charged particles would not impinge on the photocathode 16. However, light to be observed would pass through the face plate 14 and through the support 18 to impinge the photocathode 16. Although in the photodetector of the present invention the photocathode is spaced apart from the face plate and therefore cannot get as close to the source of photons as a photodetector having a photocathode on the face plate within the evacuated envelope, the gap between the photocathode and the face plate in the photodetector of the present invention can be made quite small, on the order of .01 inch (0.0254 cm.). Thus, compared to a photodetector with a reflective type photocathode, the photocathode of the present invention can still be placed closer to the source of photons to collect more of them, than the photodetector with the reflective type photocathode. Thus, the tube 10 of the present invention is useful where a transmissive type photodetector tube is to be used in an environment where Cerenkov radiation generated in the body of the tube can occur and the tube must be non-responsive to such radiation.

What is claimed is:

1. A photodetector comprising:

an evacuated envelope having a face plate, said face plate selected from a transparent material which causes internal reflection of photons generated by Cerenkov radiation in the face plate;

a transmissive type photocathode spaced apart from said face plate within said envelope; and an anode within said envelope.

2. The photodetector of claim 1 wherein said photocathode is on a support of translucent material, said support is interposed between said photocathode and said face plate and is also spaced apart from said face plate.

3. The photodetector of claim 2 wherein said face plate is a material selected from the group consisting of glass, quartz and mica.

4. The photodetector of claim 3 wherein said support is a material selected from the group consisting of glass, quartz and mica.

5. The photodetector of claim 4 wherein said photocathode is about 0.01 inch (0.0254 cm.) from said face plate.

6. The photodetector of claim 5 wherein said anode is in linear relationship with said photocathode and said face plate; and said photocathode is between said anode and said face plate.

* * * * *